US005785586A

United States Patent [19]

Delsignore

[11] Patent Number: 5,785,586

[45] Date of Patent: Jul. 28, 1998

[54] SHARPENING METHOD AND APPARATUS

[76] Inventor: Joseph Delsignore, 76 Woodland, Campbell, Ohio 44405

[21] Appl. No.: 744,093

[22] Filed: Nov. 5, 1996

[51] Int. Cl.[6] ..... B24B 3/00

[52] U.S. Cl. ..... 451/556; 76/82.2; 451/36

[58] Field of Search ..... 76/81, 81.8, 82.2; 451/45, 320–322, 552, 556, 36

[56] References Cited

U.S. PATENT DOCUMENTS

| | | |
|---|---|---|
| 1,190,718 | 7/1916 | Brunsell et al. . |
| 1,540,078 | 6/1925 | Long . |
| 1,588,322 | 6/1926 | McAdoo . |
| 2,458,257 | 1/1949 | Donovan . |
| 4,611,437 | 9/1986 | Cohen . |
| 5,036,731 | 8/1991 | Fletcher . |
| 5,431,068 | 7/1995 | Alsch . |
| 5,505,656 | 4/1996 | Moore . |

*Primary Examiner*—Douglas D. Watts
*Attorney, Agent, or Firm*—Harpman & Harpman

[57] ABSTRACT

A method and apparatus for sharpening razor blades and the like including a sharpening element with a high alumina-oxide content and a lubrication sharpening slurry. The method involved sharpening the effected surface of the blade by polishing the blade within the slurry having entrained microscopic material formed by reaction of the alumina-oxide sharpening element with the compounds of the lubrication material without actual contact of the blade with the sharpening element.

4 Claims, 2 Drawing Sheets

SHARPENING METHOD AND APPARATUS

BACKGROUND OF THE INVENTION

1. Technical Field

The present invention relates to sharpening apparatus for sharpening primarily razor blades used in shaving the face and legs of body hair.

2. Description of Prior Art

Prior art devices of this type have relied on a variety of different constructions that provide a sharpening surface on which the blade is engaged. Typically, the sharpening of a razor blade is required after limited use due to the deterioration of the edge surface by wear and microscopic oxidation caused by exposure to water and air and shaving cream chemical compounds. As a result, only a limited number of "shaves" can be achieved with a single blade. This has, in turn, spawned a large commercial market for so-called disposable razors which typically have a limited multi-use stainless blades and are designed to be discarded after several uses. To address this problem, a number of razor sharpening devices have been developed in an effort to prolong the useable life of a typical disposable razor blade.

Historically, the need for sharpening "edge" implements such as knives, scissors and razor blades have used sharpening stones, elements impregnated with diamond dust, and leather straps for honing as in the case of a barbers straight razor blade. Prior art devices to sharpen razor blades and related blades can be seen in U.S. Pat. Nos. 5,505,656, 5,431,068, 5,038,731, 4,611,437, 2,458,257, 1,588,322, 1,540,078, and 1,190,718.

In U.S. Pat. No. 5,505,656 a dental instrument sharpening guide can be seen wherein a honing stone is mounted in a bracket to expose a portion of the stone. Guide indecia positions instruments to be repeatedly engaged against the stone at a pre-determined angle for sharpening.

Pat. No. 5,431,068 is directed towards a blade sharpener in which a knife blade is held in a clamp and a honing tool supporting a sharpening stone face is moved thereagainst the fixed blade.

Pat. No. 5,036,731 shows a sharpening device especially for razor blades in which a sharpening surface is supported within a holder.

The sharpening surface which engages the blades is a non-porous glass over which the razor blade is repeatedly passed.

U.S. Pat. No. 4,611,437 discloses a sharpening system using multiple sharpening rods positioned between a pair of support frames.

Pat. No. 2,458,257 is directed towards a safety razor and blade sharpener in which a honing stone is positioned in the bottom of a opening box-like receptacle with a movable bracket configuration in which the blade is positioned and then guided against the honing surface.

Pat. No. 1,588,322 discloses a razor blade sharpener which uses magnetism to position and hold the blade against a sharpening surface.

Pat. No. 1,540,078 is directed towards a sharpener for razor blades in which a honing or sharpening surface position and two oppositely disposed parallel angular surfaces and the blade is distorted in a track between the surfaces so that the opposing edges are bent and forced for engagement thereagainst.

Finally, in U.S. Pat. No. 1,190,718, a scraper sharpener is disclosed which has a sharpening surface within two oppositely disposed grooves into which a scrapper can be positioned for sharpening by repetitive action.

SUMMARY OF THE INVENTION

A method and apparatus for sharpening "edged" blades, specifically razor blades by positioning the blade in spaced relation to a substantially flat sharpening base medium. A sharpening slurry is formed by the addition of a soap component reaction with the base medium and thus by moving the blade in spaced relation across the sharpening surface within the sharpening slurry, hones and sharpens the blade to a desired edge configuration.

DESCRIPTION OF THE PREFERRED EMBODIMENT

Referring to FIGS. 1–4 and 6 of the drawings, the sharpening system of the invention can be seen including a sharpening base element 10 with a generally rectangular configuration having an upper surface 11, a bottom surface 12 with integral oppositely disposed ends 13 and 14.

The sharpening base element 10 is formed of an alumina ceramic material having a high content of aluminum oxide ($A_2O_3$) commonly available from "Norton Pakco Industrial Ceramics" under the brand name designation of "A 92".

This custom design alumina ceramic is a fine grained high grade alumina made from pure uniformly controlled aluminum oxide as a superior wear material most commonly used in industrial environments.

Figure 1:
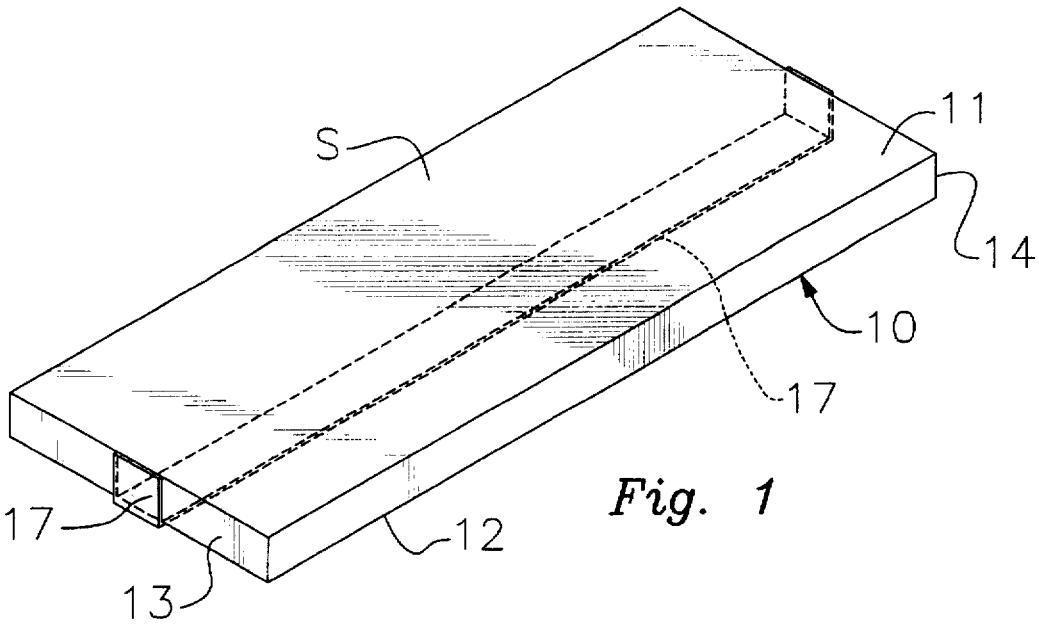
FIG. 1 is a perspective view of the sharpening base element of the invention.
Figure 3:
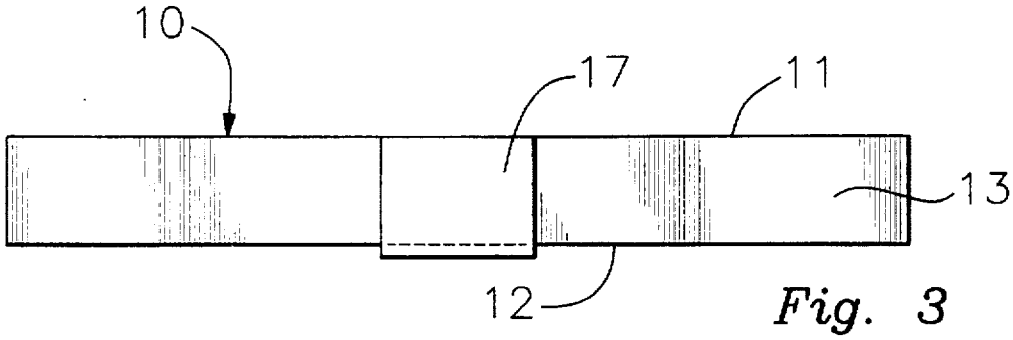
FIG. 3 is an enlarged end elevational view of a portion of the sharpening base element illustrating a spacing guide strip on the reverse side thereof for auxiliary sharpening.
Figure 4:
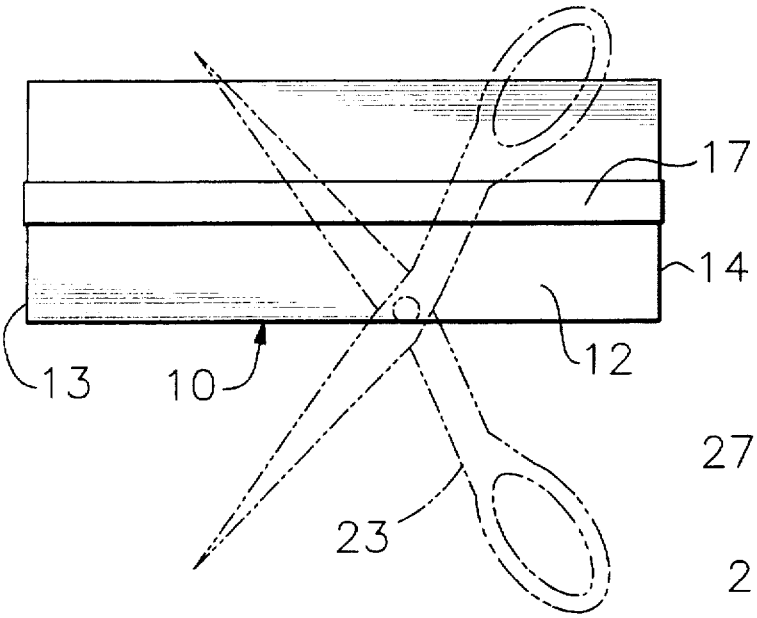
FIG. 4 is a bottom plan view of the sharpening base element seen in FIG. 1 with an auxiliary sharpening blade positioned thereon shown in broken lines.

In the preferred form of the invention a spacer band 17 formed of a metallized tape material is adhesively secured longitudinally to the bottom surface 12 of the base element 10 extending upwardly on the respective ends 13 and 14 as indicated by solid and dotted lines in FIGS. 1, 3, and 4 of the drawings. The spacer band 17 will be discussed in greater detail hereinafter.

The upper surface 11 and bottom surface 12 of the base element 10 has a lightly textured surface configuration S which is implicit in the selected ceramic compound with a high aluminum oxide content designed originally for wear characteristics.

Figure 2:
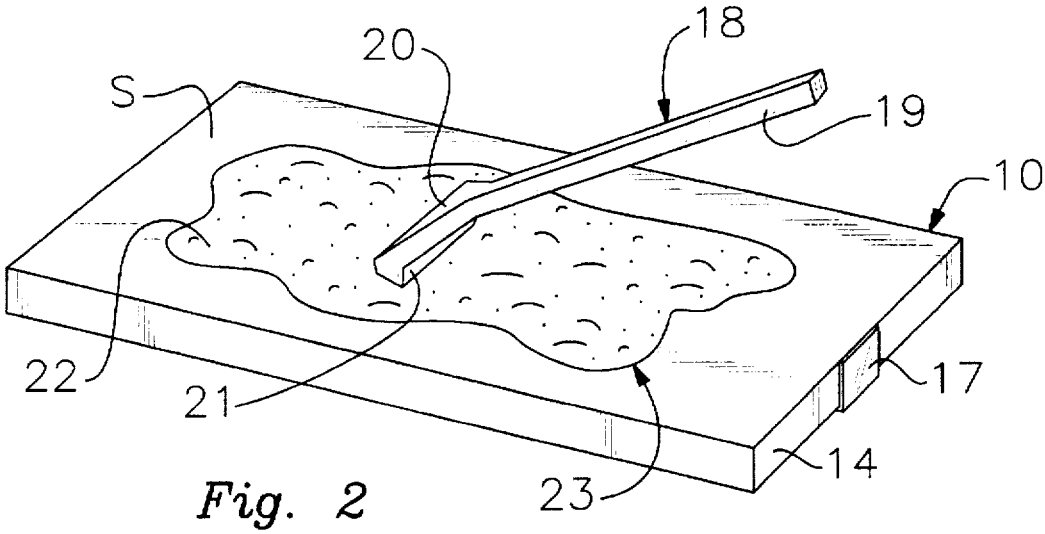
FIG. 2 is a perspective view of the present invention in use with a razor in sharpening position during sharpening.

Referring to FIG. 2 of the drawings, a typical disposable safety razor 18 is illustrated in sharpening position on the sharpening base element 10. The razor has a handle 19, a blade support head 20 and a razor blade 21 positioned within.

A sharpening slurry 22 is formed in this example on the upper surface 11 of the sharpening base element 10 by applying a liquid soap product 23 thereto and repetively advancing the razor 18 longitudinally across the upper surface 11 of the sharpening base element 10 through the soap product 23.

It has been determined that a reaction between the soap product 23 and the aluminum oxide compound of the base sharpening element 10 occurs as the razor blade 21, which is held above the actual surface S of the base element 10, is repetively passed thereacross forming a sharpening compound defined within the sharpening slurry 22 between the razor blade 21 and surface S.

The soap product 23 reacts with the ceramic aluminum oxide formulation of the base element 10 inducing a microscopic disintegration of the ceramic agglomerals therein which combined with the impurities found in the soap product 23. The slurry 22 thus contains intrained micro-abrasives that produce a fine grinding and polishing effect on the metal of the razor blade 21 typically any liquid soap product can be used that is currently available in the marketplace since it is the base ingredient and properties of any liquid soap product 23 which are well known to those skilled in the art. The well known cleaning agents in soaps are called surface active agents or surfactants. When added to a liquid they reduce its surface tension (the affinity that the surface molecules have for each other) thereby increasing the liquid spreading and wetting process that provides the desired slurry foaming action and inter-reaction with the ceramic alumina oxide formulation of the base element 10 hereinbefore described.

To achieve this slurry formation and associated polishing effect, the razor blade 21 must be repeatedly passed over the sharpening base element 10 eight to ten times.

Referring now to FIGS. 1–4 of the drawings, the spacer band 17 can be seen that as hereinbefore described is positioned on the opposite bottom surface 12 of the sharpening base element 10 for the sharpening of the blade (edge) implements such as scissors 23 illustrated in broken lines in FIG. 4 of the drawings. The spacer band 17 effectively spaces the engagement of the article above the surface S of the sharpening base element 10 so that the same slurry 22 can be formed and impart the same unique sharpening properties to the articles as hereinbefore described.

Figure 5:
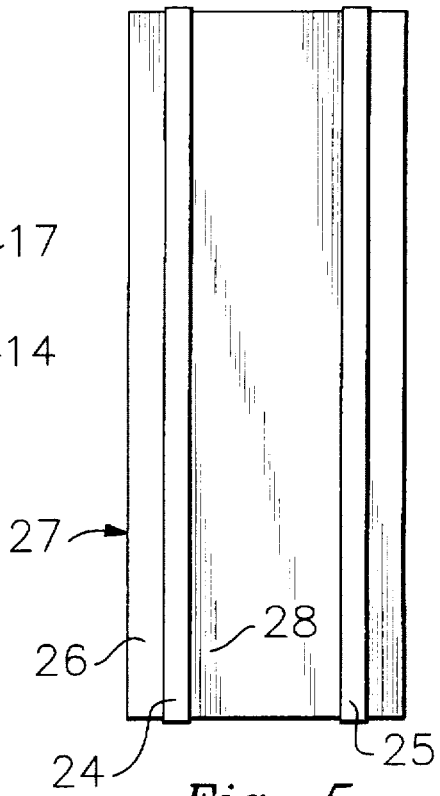
FIG. 5 is a bottom plan view of an alternate form of the invention.

Referring now to FIG. 5 of the drawings, an alternate form of the invention can be seen wherein a pair of transversely spaced spacing tapes 24 and 25 are positioned on a bottom surface 26 of an alternate sharpening base 27. This arrangement provides a uniform sharpening area 28 between the transverse spacing tapes 24 and 25.

Figure 6:
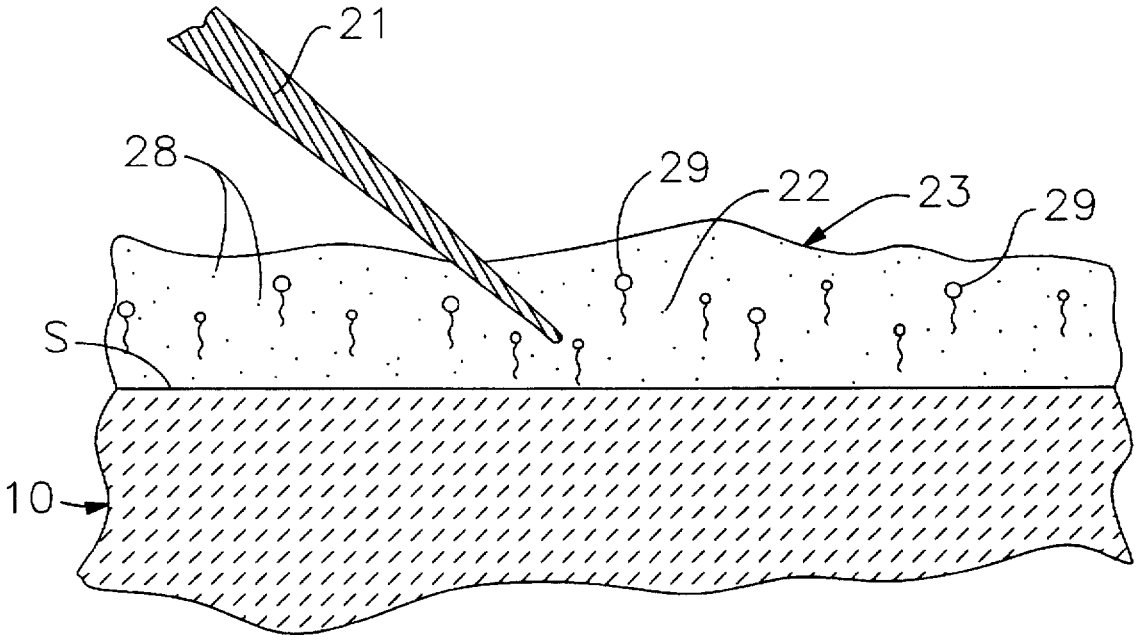
FIG. 6 is an enlarged microscopic view of the sharpening base element with a razor blade in sharpening positioning within the sharpening slurry formed thereon.

Referring to FIG. 6 of the drawings, the sharpening effect of the slurry 22 can be more readily seen with intrained soap impurities 28 and ceramic agglomerals 29 enlarged for illustration purposes to simulate the nature of the polishing and honing effect on the razor blade 21 as it is repeatedly passed over the sharpening base element 10 within the sharpening slurry 22. The invention thus described also contemplates the provision of a method which may be generally considered to be the combination of the sharpening base element 10 with a soap component and spacing the blade 21 above the surface S.

Thus it will be seen that a new and novel sharpening method and apparatus has been illustrated and described and it will be apparent to those skilled in the art that various changes and modifications may be made therein without departing from the spirit of the invention.

Therefore I claim:

1. A sharpening system for sharpening the cutting edge of a disposable safety razor comprising; a base sharpening element having a substantially flat upper and lower surfaces, said base sharpening element formed of an alumina ceramic material having an aluminum oxide $AL_2O_3$ content, a sharpening slurry disposed on said base sharpening element to be engaged by the cutting edge of said razor blade during movement of said razor blade in spaced relation along said base sharpening element, said sharpening slurry comprised of soap products, entrained micro-abrasives, formed from the soap product's reaction with said aluminum oxide material, a spacer strip on one of said base elements substantially flat surfaces.

2. The sharpening system of claim 1 wherein said flat upper and lower surfaces of said sharpening elements are textured by the aluminum oxide content.

3. The sharpening system set forth in claim 1 wherein said spacer strip is comprised of an adhesive metallized tape secured to said base element.

4. The sharpening system of claim 1 wherein said spacer strip is positioned longitudinally on said space sharpening element.

* * * * *